US007481630B2

(12) United States Patent
Liffers et al.

(10) Patent No.: US 7,481,630 B2
(45) Date of Patent: Jan. 27, 2009

(54) HAND HELD VACUUM CLEANER AND HOUSING FOR SUCH A CLEANER

(75) Inventors: Achim Liffers, Velbert (DE); Bernd Falkenstein, Wuppertal (DE)

(73) Assignee: Stein & Co. GmbH, Velbert (DE)

( * ) Notice: Subject to any disclaimer, the term of this patent is extended or adjusted under 35 U.S.C. 154(b) by 412 days.

(21) Appl. No.: 11/234,502

(22) Filed: Sep. 23, 2005

(65) Prior Publication Data

US 2006/0067843 A1 Mar. 30, 2006

(30) Foreign Application Priority Data

Sep. 24, 2004 (DE) ..... 10 2004 046 382

(51) Int. Cl.
*F04B 17/00* (2006.01)

(52) U.S. Cl. ..... 417/423.2; 417/360; 417/423.14; 15/344; 15/412; 15/327.2

(58) Field of Classification Search ..... 417/423.14, 417/423.2; 15/344, 412, 327.2; 248/638, 248/300, 640, 674

See application file for complete search history.

(56) References Cited

U.S. PATENT DOCUMENTS

| | | | | |
|---|---|---|---|---|
| 3,101,889 | A * | 8/1963 | Tatge | 417/363 |
| 3,763,635 | A * | 10/1973 | Schmitz | 55/374 |
| 4,517,705 | A * | 5/1985 | Hug | 15/351 |
| 6,484,352 | B2 * | 11/2002 | Huebsch et al. | 15/339 |
| 6,772,477 | B2 * | 8/2004 | Murphy et al. | 15/415.1 |
| 6,804,857 | B1 * | 10/2004 | Olewiler, III | 15/326 |

* cited by examiner

*Primary Examiner*—Devon C Kramer
*Assistant Examiner*—Dnyanesh Kasture
(74) *Attorney, Agent, or Firm*—W. F. Fasse; W. G. Fasse

(57) ABSTRACT

A housing for a hand held vacuum cleaner is so constructed that a suction motor mounting bracket which is enclosed by a lower housing section, is removably secured to an upper housing section. A suction coupling pipe section is either an integral part of or directly secured to the suction motor mounting bracket, so that forces introduced to a suction tool attached to the suction coupling pipe section are transmitted through the mounting bracket to the upper housing section thereby at least partly relieving the lower housing section from forces passing from the suction tool to the handle and vice versa.

8 Claims, 4 Drawing Sheets

HAND HELD VACUUM CLEANER AND HOUSING FOR SUCH A CLEANER

PRIORITY CLAIM

This application is based on and claims the priority under 35 U.S.C. §119 of German Patent Application 10 2004 046 382.4, filed on Sep. 24, 2004, the entire disclosure of which is incorporated herein by reference.

FIELD OF THE INVENTION

The invention relates to hand held vacuum cleaners and particularly to housings for such cleaners.

BACKGROUND INFORMATION

Hand held vacuum cleaners have a divided housing with an upper housing section holding a filter and a lower housing section holding a suction motor. A handle is connected to the upper housing section. The suction motor is mounted to and in the lower housing section. A suction tool is attachable to the lower housing section on the outside thereof by a suction coupling pipe section for transporting dirt carrying air into the upper housing section in which the filter separates the dirt from the suction air.

Various modifications in the arrangement of the above mentioned components are known in the art. When such vacuum cleaners are used, forces are applied to the vacuum tool e.g. when the vacuum tool is pushed against a piece of furniture or a wall. These forces are introduced into the lower housing section but the reaction force is applied through the handle secured to the upper housing section. As a result, any strain must be transmitted through the lower housing section more specifically through the connection between the upper and lower housing sections whereby a separation of the motor carrying lower housing section from the upper housing section is possible. This defect leaves room for improvement.

OBJECTS OF THE INVENTION

In view of the foregoing, it is the aim of the invention to achieve the following objects singly or in combination:

- to avoid the above problem, more specifically to permit a force transmission from a suction tool to the handle and vice versa without separating the housing sections from one another;
- to provide a connection between a mounting bracket which carries at least one function element such as a suction motor, and the upper housing section so that any lower housing section is at least partly relieved from transmitting forces; and
- to provide a lower housing section that functions as an enclosure for a mounting bracket and is at least partly relieved from transmitting forces.

The invention further aims to avoid or overcome the disadvantages of the prior art, and to achieve additional advantages, as apparent from the present specification. The attainment of these objects is, however, not a required limitation of the claimed invention.

SUMMARY OF THE INVENTION

The above objects have been achieved by the combination of the following features. A mounting bracket also referred to as motor mounting chamber for holding at least one function element, such as a suction motor, is surrounded by a lower housing section. A suction tool is carried at one end of the mounting bracket or motor mounting chamber. The other end of the mounting bracket or chamber is secured by connecting elements to the upper housing section, for example by releasable screws, whereby forces applied to the suction tool are transmitted primarily through the mounting bracket and through the connecting elements to the upper housing section and to thereby at least partly bypass the lower housing section which is thus relieved from transmitting certain forces. A form locking connection between the mounting bracket and the upper housing section is optional.

Preferably, the mounting bracket is formed by contoured walls of sufficient strength for the transmission of forces. The mounting bracket walls form an enclosure or chamber for the suction motor and are in turn enclosed by the lower housing section. The chamber forming the mounting bracket has for example at least one slanted bottom wall which facilitates the arrangement of air flow channels through the mounting bracket and efficiently uses the available space. A suction coupling pipe section is either secured to or formed as an integral part of the mounting bracket. Independently of the shape of the mounting bracket, the suction coupling pipe section is preferably secured to or an integral part of a wall of the mounting bracket.

The mounting bracket forms an enclosure for the suction motor which may be mounted to any wall portion of the mounting bracket, for example to a bottom or side wall of the mounting bracket. When two slanted mounting bracket bottom walls are provided, these walls extend preferably, but not necessarily, at a right angle to each other but at another angle to the vertical, e.g. 45°. The suction motor is preferably mounted to both slanted bottom walls so that the motor's rotation axis extends in parallel to one slanted bottom wall and perpendicularly to the other slanted bottom wall which provides a very efficient use of the available space.

BRIEF DESCRIPTION OF THE DRAWINGS

In order that the invention may be clearly understood, it will now be described in connection with an example embodiment thereof, with reference to the accompanying drawings, wherein.

DETAILED DESCRIPTION OF A PREFERRED EXAMPLE EMBODIMENT AND OF THE BEST MODE OF THE INVENTION

Figure 1:
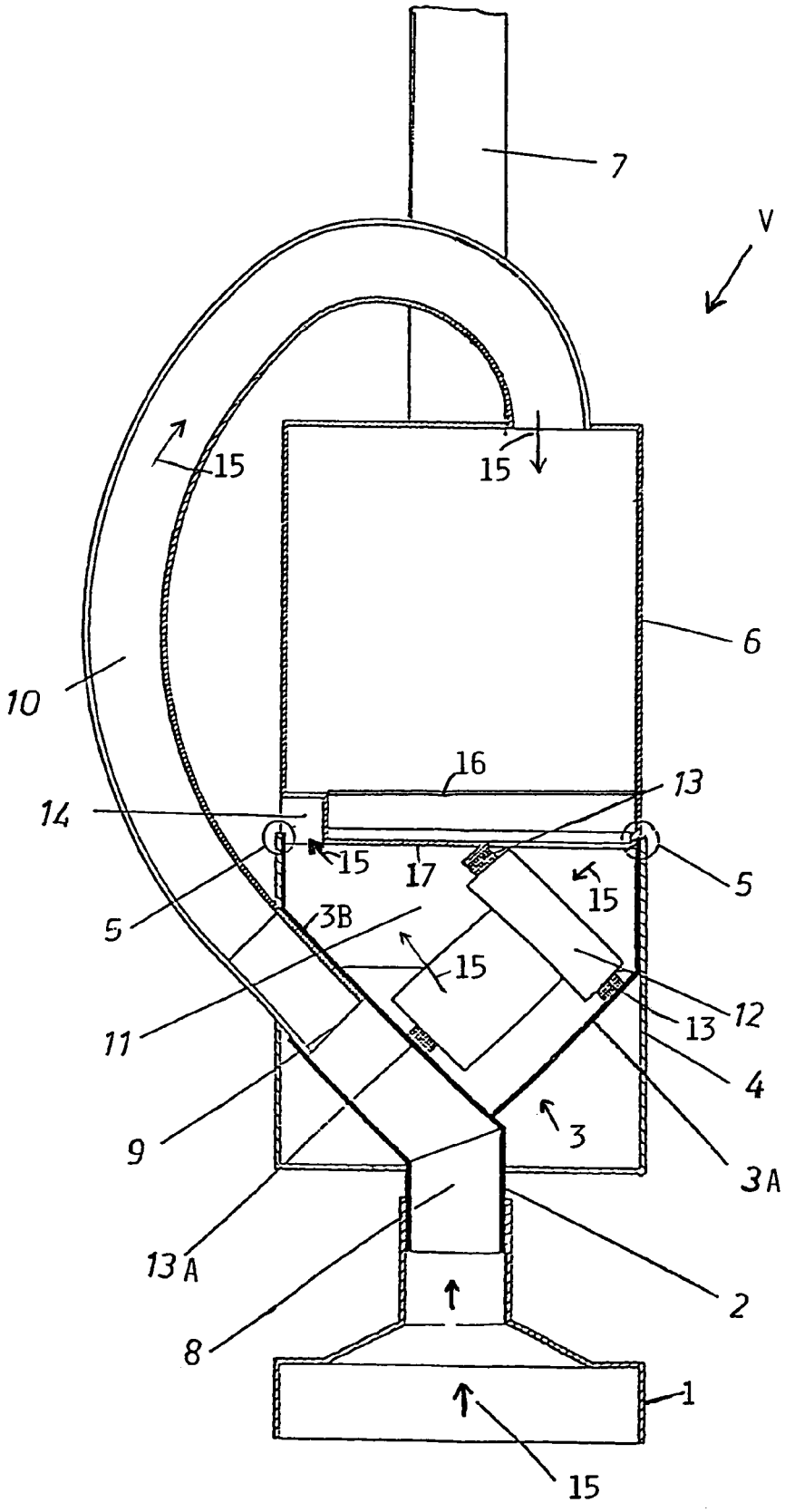
FIG. 1 shows an overall view of a hand held vacuum cleaner according to the invention.
Figure 4:
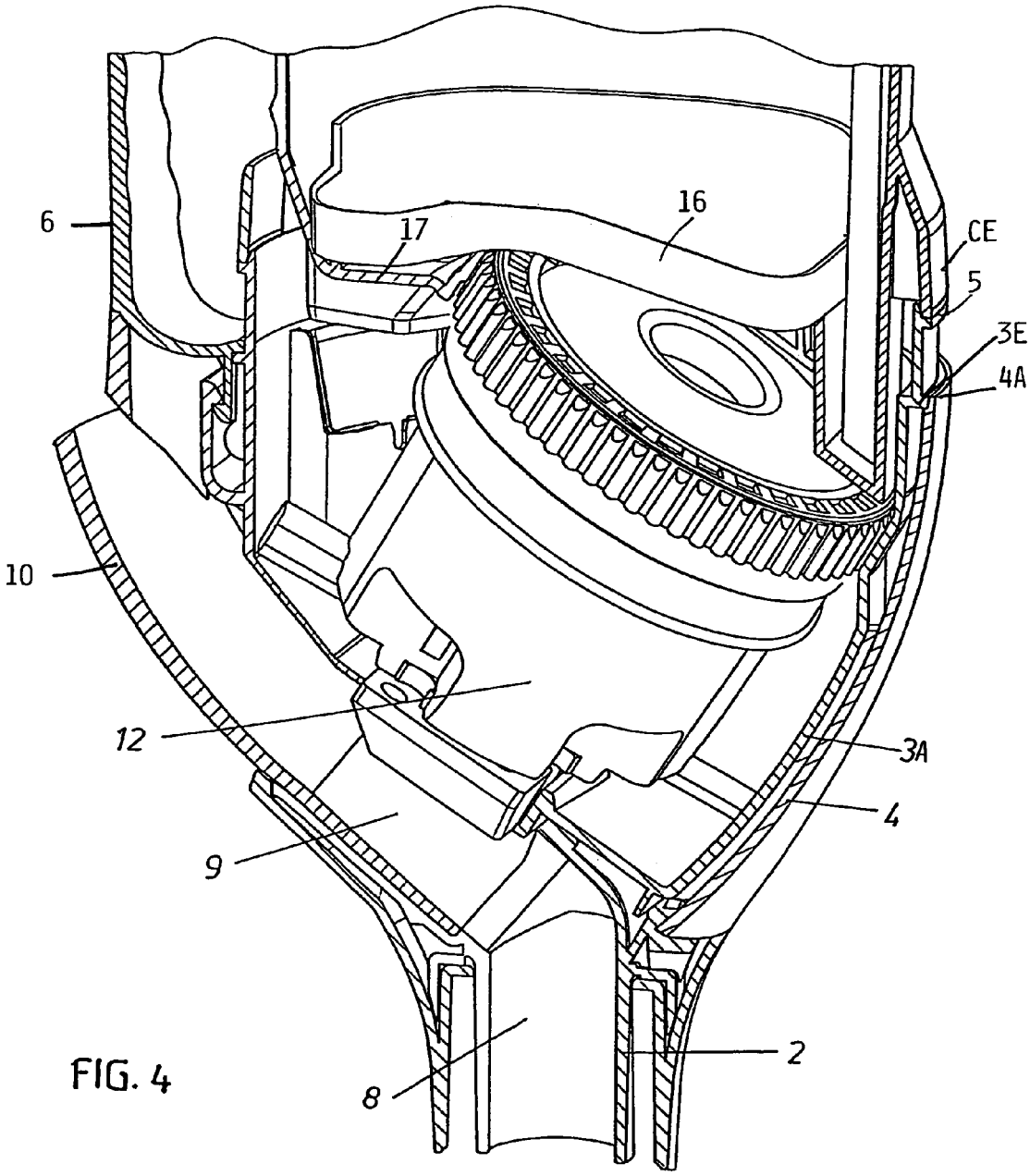
FIG. 4 is a view similar to that of FIG. 3 but showing only a lower portion of the present vacuum cleaner with the suction motor secured in the present mounting bracket.

Referring to FIG. 1 the present hand held vacuum cleaner V has a vacuum tool 1 exchangeably secured to a suction coupling pipe section 2 which is preferably an integral component of a separate motor mounting bracket 3 that forms a motor mounting chamber 11 according to the invention. Alternatively, the coupling pipe section 2 may be attachable to the separate motor mounting bracket. The vacuum cleaner V has a lower housing section 4 functioning as a cover and an upper housing section 6 functioning as a force transmitting component and as a filter housing. The lower housing section or cover 4 is removably secured at 3E to the separate mounting bracket 3 by a connecting flange 4A, please see FIG. 4. The separate motor mounting bracket 3 in turn is rigidly but releasably connected to the upper housing section 6 by a connecting element such as a flange. 5 connected to a complementary element CE of the upper housing section 6 as best seen in FIG. 4. Thus, this connection of the separate motor mounting bracket 3 to the upper housing section 6 is a force transmitting connection. The lower housing section 4 forms an envelope for the separate motor mounting bracket 3 with a gap between a mounting bracket wall 3A and the cover 4 as shown in FIG. 4. The separate motor mounting bracket 3 participates in the force transmission between the suction tool 1 and a handle 7 secured to the upper housing section 6. Forces applied to the handle are also transmitted through the separate motor mounting bracket 3 to the tool 1. Thus, the separate motor mounting bracket 3 at least partly relieves the lower housing section or cover 4 from transmitting forces between the tool 1 and the handle 7, whereby an unintended separation of the housing section or cover 4 and the housing section 6 from each other is prevented.

The suction coupling pipe section 2 forms a suction channel one end 8 of which is releasably connected to the suction tool 1 while the other end 9 is releasably connected to a suction hose 10 that leads to a filter space enclosed by the upper housing section 6. The arrows 15 shown in FIG. 1 illustrate the flow of the suction air generated by a function element such as a suction motor 12 mounted in a chamber or enclosure 11 formed by the mounting bracket 3.

Figure 2:
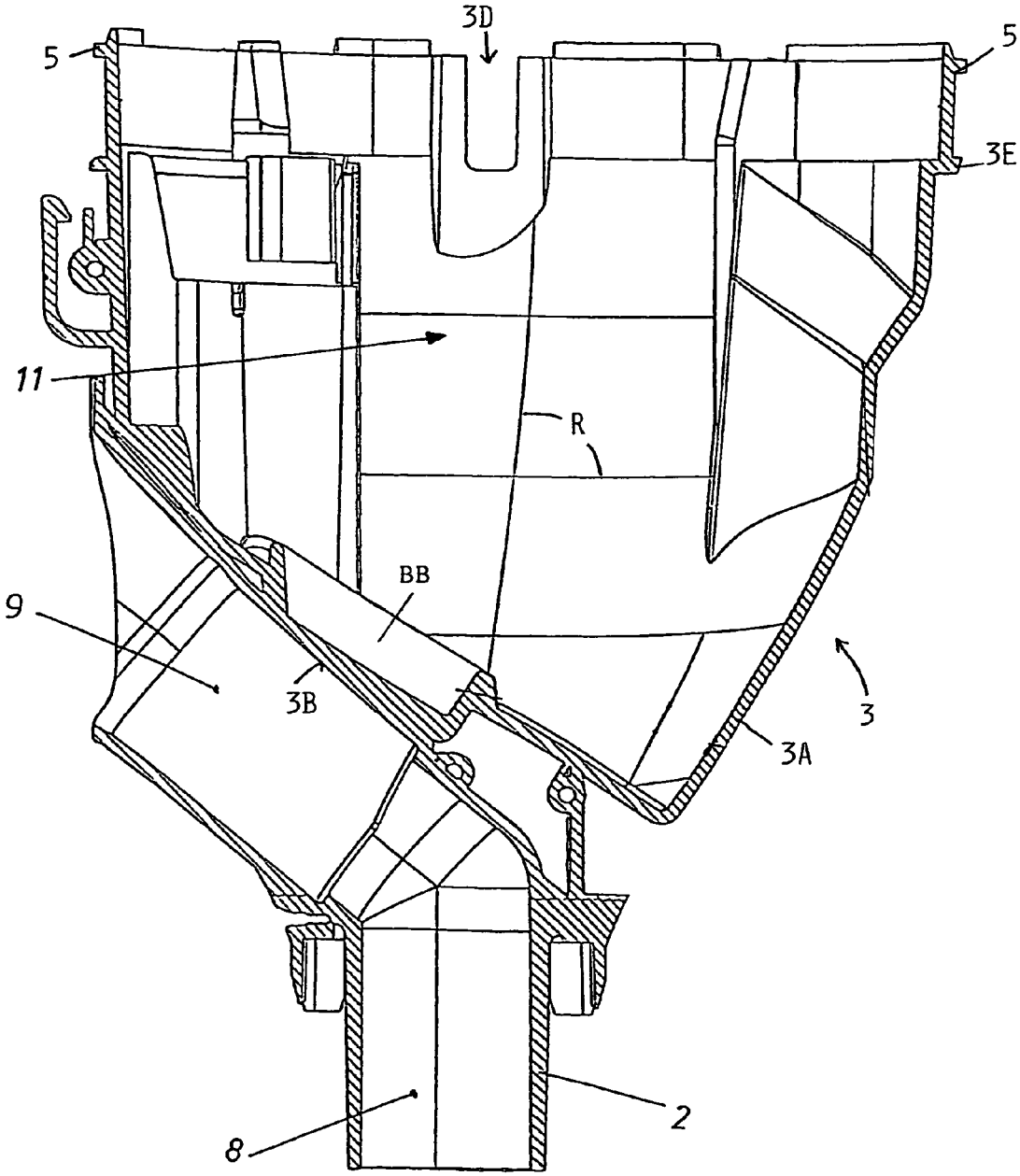
FIG. 2 is an axial sectional view through the present mounting bracket formed as a chamber with contoured walls, the suction motor is not shown.
Figure 3:
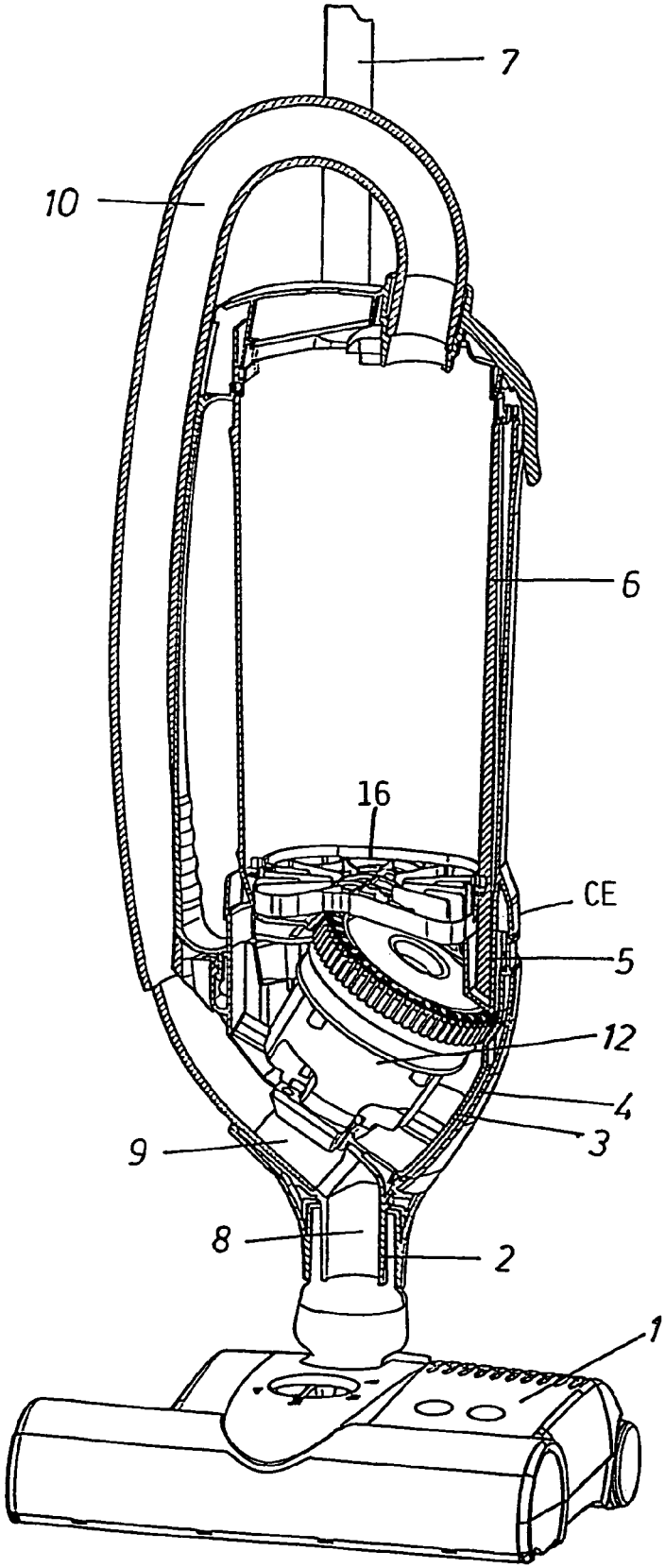
FIG. 3 is a perspective and sectional view through the present vacuum cleaner.

Referring to FIGS. 1 and 2, the mounting bracket 3 has bottom walls 3A and 3B interconnected with each other for example at an angle, such as approximately 90°, and contoured side walls to form the chamber or enclosure 11 in which the suction motor 12, not shown in FIG. 2, is mounted, preferably so that the rotation axis of the motor 12 extends in parallel to a wall 3A and perpendicularly to another wall 3B of the mounting bracket 3. For this purpose, a bearing bed BB for the bearing or support 13A of the suction motor 12 is formed in the bottom wall 3B. The element CE is, for example, a rim that fits onto the flange 5 and both elements are interconnected for example by releasable screws, not shown.

The chamber 11 formed by the mounting bracket 3 also functions as a noise damper and holds the motor support elements 13, 13A. The support elements 13 preferably also have a sealing characteristic for sealing a suction inlet of the motor 12 from an air discharge outlet 14 from the chamber 11. A contour 3D of the mounting bracket 3 facilitates centering the mounting bracket 3 relative to the upper housing section 6.

Referring further to FIGS. 1 and 2 in conjunction the air discharge outlet 14 is preferably provided in the connection area between the upper housing section 6 and the mounting bracket 3 for example just above the area of the connecting flange 5 through a port in the wall of the mounting bracket 3 for discharging air from the air discharge side of the motor 12. The lower housing section 4 has an upper rim 4A which encircles a cooperating portion, such as a collar 3E, of the mounting bracket 3. A cover 17 below a filter 16 separates the air discharge side of the chamber 11 from the upper housing section 6.

The rigid screw connection between the mounting bracket 3 and the upper housing section 6 is a disconnectable connection. The mounting bracket 3 carries the suction connection pipe section 2, preferably as an integral part of the bracket 3. Thus, the suction connection pipe section 2 with the tool 1 attached thereto, is connected to the handle 7 through the bracket 3 and through the upper housing section 6. This connection train assures a secure and proper force transmission between the tool 1 and the handle 7 and vice versa without any danger that the mounting bracket 3, which also carries the lower housing section 4, is separated from the upper housing section 6.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A vacuum cleaner comprising a filter housing (6) having a longitudinal housing axis, said filter housing enclosing a filter space, a handle (7) secured to said filter housing (6), a separate motor mounting chamber (11), securing means (5, CE) rigidly and releasably connecting said separate motor mounting chamber (11) to said filter housing (6), a motor (12) operatively secured inside said separate motor mounting chamber (11), said separate motor mounting chamber comprising a first chamber wall (3B) and a second chamber wall (3A) enclosing said separate motor mounting chamber (11), said first and second chamber walls (3B, 3A) slanting at a first angle relative to each other and at a second angle relative to said longitudinal housing axis, a suction pipe section (2) rigidly secured to said first wall (3B) of said separate motor mounting chamber (11) so that forces effective on said suction pipe section (2) are directly transmitted from said suction pipe section (2) through said separate motor mounting chamber (11) to said filter housing (6), and a separate cover (4) secured to said separate motor mounting chamber (11) so that said separate cover (4) is relieved by said separate motor mounting chamber (11) from transmitting said forces effective on said suction pipe section (2) to said filter housing (6).

2. The vacuum cleaner of claim 1, wherein said securing means (5, CE) comprise a rigid flange (5) as part of said separate motor mounting chamber (11) and a rigid rim (CE) as part of said filter housing (6), said rigid rim (CE) cooperating with said flange (5) for rigidly securing said separate motor mounting chamber (11) and said filter housing (6) to each other.

3. The vacuum cleaner of claim 1, wherein said first chamber wall (3B) and said second chamber wall (3A) of said separate motor mounting chamber (11) are slanted at said first angle toward each other thereby forming a downwardly facing ridge.

4. The vacuum cleaner of claim 3, wherein said first angle is a right angle, wherein said motor (12) has a rotational motor axis extending perpendicularly to said first chamber wall (3B) and parallel to said second chamber wall (3A) whereby said motor axis is slanted relative to said longitudinal housing axis at said second angle.

5. The vacuum cleaner of claim 4, wherein said first and second chamber walls (3B, 2A) form a slanting bottom of said motor mounting chamber, said first chamber wall (3B) comprising a bearing bed (BB) and wherein one end of said motor (12) is mounted in said bearing bed (BB).

6. The vacuum cleaner of claim 1, further comprising support elements (13, 13A) positioned between said motor (12) and said separate motor mounting chamber (11).

7. The vacuum cleaner of claim 6, wherein at least one of said support elements functions as a seal (13) between a suction side of said motor (12) and a discharge side of said motor (12).

8. The vacuum cleaner of claim 1, wherein said cover (4) comprises an upper rim (4A) connected to said separate motor mounting chamber (11) along a top edge of said separate motor mounting chamber (11), said cover (4) further having a lower rim connected to a lower edge of said separate motor mounting chamber (11) with a spacing between said cover (4) and said chamber second wall (3A) of said separate motor mounting chamber (11) so that forces effective on said suction pipe section (2) pass through said first and second chamber walls (3B, 3A) to said filter housing (6) and said cover (4) is relieved from transmitting said forces.

* * * * *

UNITED STATES PATENT AND TRADEMARK OFFICE

CERTIFICATE OF CORRECTION

PATENT NO. : 7,481,630 B2
APPLICATION NO. : 11/234502
DATED : January 27, 2009
INVENTOR(S) : Liffers et al.

It is certified that error appears in the above-identified patent and that said Letters Patent is hereby corrected as shown below:

On the cover page,

Item [*] Notice: Subject to any disclaimer, the term of this patent is extended or adjusted under 35 USC 154(b) by 412 days Delete the phrase "by 412 days" and insert -- by 371 days --

Signed and Sealed this

Seventh Day of July, 2009

JOHN DOLL
*Acting Director of the United States Patent and Trademark Office*